US007647882B2

(12) United States Patent
Michelbrink et al.

(10) Patent No.: US 7,647,882 B2
(45) Date of Patent: Jan. 19, 2010

(54) STRIP COATING DEVICE

(75) Inventors: Thomas Michelbrink, Wesel-Bislich (DE); Dieter Baukloh, Duisburg (DE); Andreas Noé, Kerken (DE)

(73) Assignee: BWG Bergwerk- und Walzwerk-Maschinenbau GmbH, Duisburg (DE)

( * ) Notice: Subject to any disclaimer, the term of this patent is extended or adjusted under 35 U.S.C. 154(b) by 215 days.

(21) Appl. No.: 11/648,405

(22) Filed: Dec. 29, 2006

(65) Prior Publication Data

US 2007/0163492 A1 Jul. 19, 2007

(30) Foreign Application Priority Data

Jan. 14, 2006 (EP) ..... 06000779

(51) Int. Cl.
*B05C 1/08* (2006.01)

(52) U.S. Cl. ..... 118/262; 118/258; 118/247; 118/248; 118/249

(58) Field of Classification Search ..... 118/246–249, 118/258, 262; 427/428.16, 428.21
See application file for complete search history.

(56) References Cited

U.S. PATENT DOCUMENTS

| | | | | | |
|---|---|---|---|---|---|
| 221,403 | A | * | 11/1879 | Eyster | 156/164 |
| 1,112,812 | A | * | 10/1914 | Labombarde | 118/225 |
| 4,845,964 | A | | 7/1989 | Bors et al. | |

FOREIGN PATENT DOCUMENTS

| | | |
|---|---|---|
| DE | 196 21 993 | 12/1996 |
| GB | 888 972 | 2/1962 |

* cited by examiner

*Primary Examiner*—Brenda A Lamb
(74) *Attorney, Agent, or Firm*—Collard & Roe, P.C.

(57) ABSTRACT

A strip coating device for coating of strips, particularly metal strips, has at least one application head for applying coating substances to the strip. The application head has at least one application roller that applies the coating substance to the strip, and having at least one supporting roller disposed on the side of the strip opposite the application head. The application head works on the strip either in a first functional position where the strip is supported by the supporting roller, or, in a second functional position outside of the supporting region of the supporting roller.

14 Claims, 10 Drawing Sheets

2
B
A
9
10
11
12
13
14
15
16
17
18
19
20
21
22
23

9
14
20
16
13
18
12
17
10
15
11

STRIP COATING DEVICE

BACKGROUND OF THE INVENTION

1. Field of the Invention

The invention relates to a strip coating device for continuous coating of strips, particularly metal strips, having at least one application head for applying liquid coating substances to a strip passing through the coating device. The application head has at least one application roller that applies the coating substance to the strip, and at least one supporting roller disposed on the side of the strip opposite the application head.

Within the scope of the invention, strips particularly means metal strips, for example steel strips or aluminum strips. Coating of such strips particularly means application of non-metallic, organic layers or coverings. In this regard, the application of liquid coating substances, for example varnishes or also plastics, is particularly involved. In addition to the application roller, the application head generally has at least one accommodation roller that accommodates the coating substance and gives it off to the application roller, directly or indirectly. If supply of the coating substance takes place by dipping the accommodation roller into a container, this roller is referred to as a scooping roller. If the application head merely consists of the accommodation roller and the application roller, one speaks of a two-roller head, and the accommodation roller then forms a metering roller, at the same time. However, within the scope of the invention, application head also means a so-called three-roller head, in which a metering roller or regulating roller is disposed between the accommodation roller and the application roller. Both two-roller heads and three-roller heads can be equipped to operate by rolling in the same direction or opposite directions.

2. The Prior Art

Strip coating devices are known in which the application head is disposed directly opposite the supporting roller, so that coating essentially takes place against the supporting roller. This has the advantage that the strip is perfectly supported during the coating process. However, in particular when coating thin strips, there is the problem that the coating substance is applied not only onto the strip to be coated, but also directly onto the supporting roller, since the application roller of the application head is generally wider than the strip to be coated, in order to assure a perfect coating process. Such contamination of the supporting roller, which is also called a "tambour," is particularly undesirable if the position of the strip on the supporting roller changes as the strip passes through. Then an undesirable coating of the back of the strip can occur. The same thing applies in the case that varnish or the like runs onto the supporting roller.

It is therefore also known to provide the supporting roller with a mantle or stocking of rubber, for example, which has a width that is equal to the width of the strip to be coated. A disadvantage of this is the fact that the mantle must be replaced when the strip width changes, so the system must be stopped during the replacement.

Strip coating devices without a supporting roller are known, in which the application head works on a free strip region. The strip to be coated stands under strip tension in this region. It must always be noted that there are geometrical constraints for the strip guidance, because of the ovens that regularly follow the coating devices.

SUMMARY OF THE INVENTION

It is therefore an object of the invention to create a strip coating device of the type described above, which allows perfect coating and, at the same time, can be flexibly used for different purposes and, in particular, for different strip thicknesses.

This object is accomplished according to the invention by a strip coating device having an application head that works on the strip optionally either in a first functional position of the strip coating device, directly in the supporting region of the supporting roller, or, in a second functional position of the strip coating device, in a free strip region outside of the supporting region of the supporting roller. The coating device according to the invention has a combined structure, in which coating can take place in different functional positions of the device, either against a supporting roller or against a free strip under strip tension, with one and the same application head. With this, there is the possibility, for example, when using thick strips (thickness≧0.3 mm), to perform coating against the supporting roller, in known manner, since contamination of the supporting roller does not have to be feared if the strip thickness is sufficient, and use of the supporting roller allows perfect guidance of the strip. Then, after having switched the functional position to the second functional position, it is possible to coat thin strips (thickness<0.3 mm), for example, against the strip tension in a free strip region.

In this connection, it is practical if the supporting roller has at least one tensioning roller assigned to it on the side lying opposite the application head. This tensioning roller can precede or follow the supporting roller, in the strip running direction, by a predetermined distance. The application head, i.e. its application roller, then works on the strip either directly against the supporting roller, in the first functional position of the strip coating device, or, in the second functional position of the strip coating device, in the free strip region between the supporting roller and the tensioning roller. The tensioning roller can consequently have been put essentially out of function in the first functional position, while it assures the desired strip tension and perfect guidance of the strip in the second functional position, in interplay with the supporting roller and the application head.

Within the scope of the invention, the first functional position for coating preferably thick strips, the application roller of the application head and the supporting roller are disposed so that the distance between the surface of the application roller and the surface of the supporting roller approximately corresponds to the thickness of the strip to be coated. Consequently, the application roller rests directly against the supporting roller, with the interposition of the strip. Within the scope of the invention, thick strips means strips having a thickness of approximately 0.3 mm and more, for example. In contrast, in the second functional position, for coating thin strips, for example, the distance between the surface of the application roller and the surface of the supporting roller and/or the surface of the tensioning roller is greater than the thickness of the strip running through, by a predetermined dimension, in every case. It is practical if this distance, which is greater than the strip thickness, is selected to be relatively small, in order to achieve optimal guidance of the strip within the strip coating device. Within the scope of the invention, thin strips means strips having a thickness that is less than approximately 0.3 mm, for example. In this connection, the distance of the surface of the application roller from the surface of the supporting roller and/or the surface of the tensioning roller is less than 20 mm, preferably less than 10 mm, for example less than 5 mm, in the second functional position of the strip coating device. Thus, a distance of 1 mm to 5 mm can be particularly practical. Taking into consideration a strip thickness that cannot be ignored, the aforementioned distance is maximally 20 mm greater than the strip thickness, preferably maximally 10 mm greater than the strip thickness, for example maximally 5 mm greater than the strip thickness. In this regard, it can be practical if the distance is approximately 1 mm to 5 mm greater than the strip thickness.

According to a preferred embodiment of the invention, the strip is guided in the strip coating device in such a manner in the second functional position, that the looping angle of the strip around the application roller is less than 40°, preferably less than 30°, for example 10° to 20°. The looping angle depends on the radii of the rollers and the distance between the supporting roller and the tensioning roller, and on the "immersion depth" of the application roller into the region between the supporting roller and the tensioning roller.

According to a further embodiment of the invention, the supporting roller and the tensioning roller are disposed in or on a common roller frame. The position of the supporting roller and/or the position of the tensioning roller within the roller frame is adjustable, for a switch from one functional position into the other functional position.

In this connection, the tensioning roller and the supporting roller are mounted to rotate or are able to rotate each in a rotary frame, whereby the rotary frame itself is mounted to rotate within the roller frame. By arranging the tensioning roller and the supporting roller in a rotating rotary frame, the coating device can be quickly brought from the first functional position into the second functional position in a particularly simple manner, namely in that the rotary frame, with its rollers, is rotated by a corresponding angle of rotation. Complicated replacement of individual rollers is consequently not necessary. A greater change in position of the application head is also not required, since the change in functional position is primarily brought about by suitable positioning of the supporting roller and the tensioning roller, for example by the rotary frame. Nevertheless, it can be practical or necessary to also move the application head by a slight dimension, additionally to the adjustment to the functional position of the supporting roller and the tensioning roller. In this connection, the rotary frame has at least two rotary arms that connect the supporting roller and the tensioning roller with one another on their faces. The supporting roller and the tensioning roller are mounted on the rotary arms, on their ends, and the rotary frame can be rotated about a rotation axis disposed between the rotation axes of the rollers.

Preferably, one or more rotary drives are connected with the rotary frame, for example at one or both rotary arms. These allow an automated change in the functional positions. The rotary drives can be configured as linear drives, for example cylinder/piston arrangements, which are either connected directly with the rotary frame, for example with the rotary arms, or are connected by way of at least one transfer lever. The transfer lever can be configured as a crank or also as a turntable. The linear drives then engage eccentrically on such a crank or table. In any case, perfect translation of a linear drive movement into a rotary movement of the rotary frame, for the purpose of switching from one functional position to the other functional position, takes place in every case, by the use of a transfer lever. However, alternative drive concepts are also possible. Thus, for example, work can be carried out with electric motor drives that act on the shaft, with the interposition of gear mechanisms, in place of linear drives. Furthermore, there is the possibility of working with hydraulic pivot drives, for example.

The cylinder/piston arrangements that form the linear drives can be cylinder/piston arrangements that work hydraulically, pneumatically, or also electrically.

In a modified embodiment of the invention, at least the tensioning roller (and, if necessary, also the supporting roller) is mounted to rotate on a pivot frame. The tensioning roller can be pivoted with the pivot frame for the switch from one functional position into the other functional position. Such a pivot frame can have at least two pivot arms on which the tensioning roller is mounted, for example at the ends. Consequently, the supporting roller and the tensioning roller are not both moved within the roller frame with a rotary frame, but instead it can be sufficient to merely pivot the tensioning roller relative to the strip and/or to the supporting roller, in order to bring the coating device from the first functional position into the second functional position and vice versa. In the first functional position, with coating against the supporting roller, the tensioning roller is consequently pivoted out of the strip region. If, on the other hand, coating is supposed to take place against the strip under strip tension, the tensioning roller is pivoted towards the strip, while the supporting roller can fundamentally remain in its position. Preferably, however, the position of the supporting roller within the roller frame is also movable. For this purpose, the supporting roller can be displaceable, for example on linear guides, specifically also by way of suitable drives, namely displacement drives. Preferably, the tensioning roller is pivoted about a separate pivot axis of the pivot frame, which is at a distance from the rotary axis of the supporting roller. However, the pivot frame can also be connected with the supporting roller, so that the tensioning roller is pivoted about the supporting roller, i.e., the pivot axis of the pivot frame essentially coincides with the rotation axis of the supporting rollers.

It can be necessary to move the application head into the free strip region between supporting roller and tensioning roller, so that then coating can take place under strip tension, against the free strip between supporting roller and tensioning roller. With this embodiment, pivot drives are connected with the pivot frame, for example at the pivot arms. These pivot drives can also be configured as linear drives, for example cylinder/piston arrangements, which can be connected to the pivot arms directly or indirectly. In this connection, the pivot drives are connected with the free end of the pivot levers, lying opposite the tensioning roller, so that the pivot axis is disposed between tensioning roller or tensioning roller bearing and linkage of the pivot drives. In a modified embodiment, the pivot drives can engage on the pivot lever between the supporting roller and the tensioning roller.

The embodiments of the invention that have been described as preferred embodiments until now provide not only the supporting roller but also a tensioning roller, and the application head then performs application against the strip in a functional position between the supporting roller and tensioning roller. In a simplified embodiment, however, the tensioning roller can be eliminated, so that only the supporting roller and/or the application head must be moved to change the functional position, and the application head optionally works either against the supporting roller or against a free strip region next to the supporting roller.

The strip coating devices according to the invention are regularly a component of a strip coating system that usually consists of several strip coating devices. Several strip coating devices can be provided, in particular, for strip coating on the top, on the one hand, and on the bottom, on the other hand. In this connection, the embodiments that have been described can be combined with one another.

In total, the invention makes perfect strip coating possible with a strip coating device that is flexibly suited for completely different purposes. The same strip coating device can be optionally operated in different functional positions, which allow coating against the supporting roller, and coating against strip tension, i.e. against the free strip. This is possible, in a particularly simple manner, with the use of the rotary and/or pivot frames as described. The work can be carried out with minimal setting paths of the related application heads. This facilitates handling by operators working on the devices. Furthermore, the entire strip guidance within a continuous pass through a strip coating system is not influenced by the change in the functional positions, or only influenced slightly, so that strip guidance in the region of subsequent ovens, in particular, is not negatively influenced.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
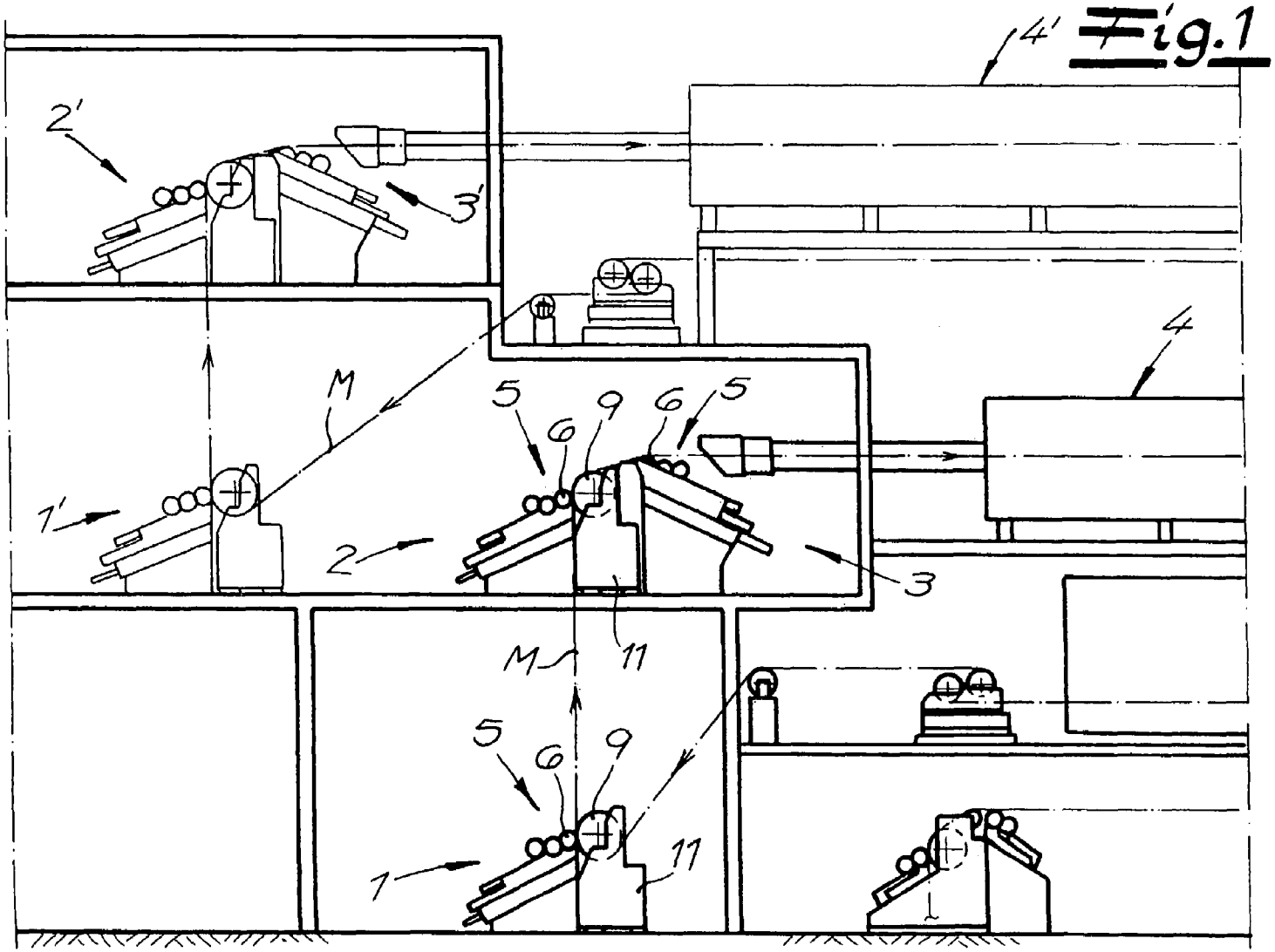
FIG. 1 shows a strip coating system having several strip coating devices according to the invention, in a schematic view.

Referring now in detail to the drawings, FIG. 1 shows a schematic representation of a strip coating device for metal strips M, in which metal strip M to be coated passes through a plurality of strip coating devices. In the lower region of FIG. 1, a first coating device 1 according to the invention, for top coating of the strip M, is shown. Directly above that, a second coating device 2, also for top coating, is disposed, followed directly in the strip running direction by a third coating device 3 for bottom coating of the strip. After having passed through one or more of these coating devices 1, 2, 3, the strip runs into an oven 4, with which the coating substances, which were applied in liquid form, are cured. Optionally, there is then the possibility that the strip that has been coated on the top and/or the bottom, using coating devices 1, 2, 3, as described, passes through additional coating devices 1', 2', 3' shown in the left upper region of FIG. 1, in order to apply additional coatings on the top and/or the bottom. These optional coating devices 1', 2', 3' are then optionally followed by another oven 4'.

Each individual one of strip coating devices 1, 2, 3, 1', 2', 3' has an application head 5 for applying liquid coating substances, for example varnishes, to the strip. Each application head 5 has at least one application roller 6, which applies the varnish to the strip. In the exemplary embodiment, application heads 5 are configured as three-roller heads, which have not only the actual application roller 6, but also an accommodation roller 7 and a metering roller 8 disposed between accommodation roller 7 and application roller 6. Accommodation roller 7 accommodates the coating substance and passes it to application roller 6 by way of metering roller 8. The structure of these known application heads is shown as an example in FIGS. 7*a*, 7*b*. In this connection, the entire application head 5 is displaceable, so that depending on the mode of operation, application head 5, in each instance, can be moved out of the strip region or moved into the strip region.

Thus, there is the possibility, for example, of undertaking merely top coating with strip coating device 1, while application heads 5 of strip coating devices 2, 3 are moved out of the strip region. If, on the other hand, both top coating and bottom coating are supposed to take place, this can be done using application heads 5 of strip coating devices 2, 3, while application head 5 of strip coating device 1 is moved out of the strip region. The same holds true for the optional strip coating devices 1', 2', 3'.

Each of strip coating devices 1, 2, 1', 2' according to the invention has a supporting roller 9 on the side of strip M that lies opposite application head 5. In this embodiment, the strip to be coated loops around this roller by a predetermined looping angle. In this connection, supporting rollers 9, also called tambours, regularly have a greater diameter than application rollers 6. Application head 5 works on the strip optionally either in a first functional position of strip coating device 1, 2, directly in the supporting region of the supporting roller 9, or, in a second functional position of strip coating device 1, 2, in a free strip region outside of the supporting region of supporting roller 9. This is evident, for example, from a comparison of FIGS. 2*a* and 2*b* (or FIGS. 7*a*, 7*b*), which furthermore show that supporting roller 9 additionally has a tensioning roller 10 assigned to it on the side of metal strip M that lies opposite application head 5.

Figure 2A:
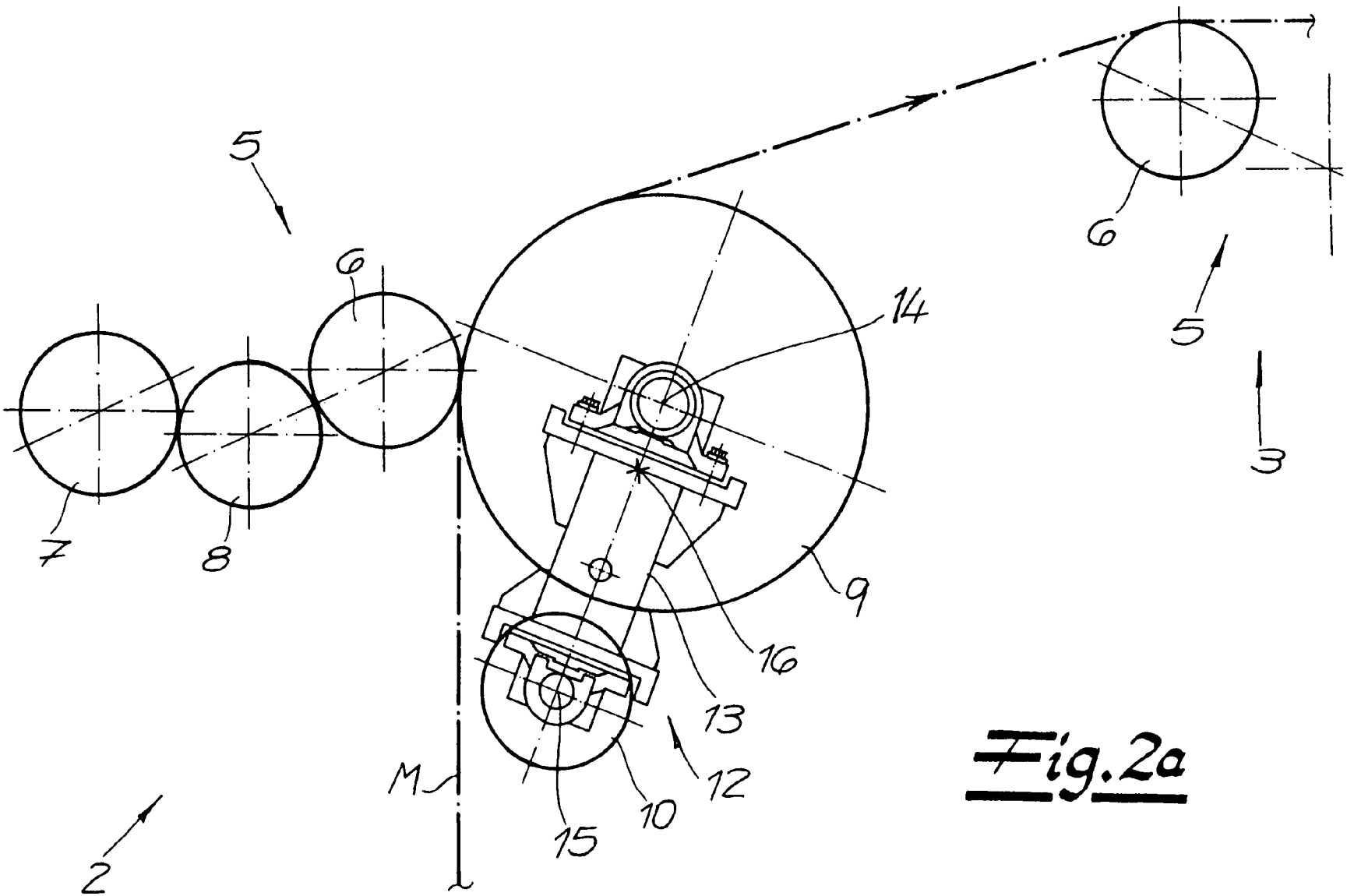
FIG. 2*a* shows an embodiment of a strip coating device according to the invention, in a first functional position.

FIG. 2*a* (and FIG. 7*a*, respectively) show strip coating device 1, 2 in a first functional position, in which application head 5 is disposed directly in the supporting region of supporting roller 9, so that application roller 6 is supported on supporting roller 9, with the interposition of the strip M to be coated. This mode of operation is particularly good for coating thick strips, in which contamination of supporting roller 9 is precluded due to the distance between application roller 6, on the one hand, and supporting roller 9, on the other hand, which is then sufficient. If, on the other hand, thin strips are supposed to be coated, strip coating device 1, 2 can be brought from the first functional position shown in FIG. 2*a* (and 7*a*, respectively), into the second functional position shown in FIG. 2*b* (and 7*b*, respectively).

Application head 5, i.e. its application roller 6, now no longer works against supporting roller 9, but rather against the strip tension, i.e., application roller 6 lies against the strip in a free strip region between supporting roller 9 and tensioning roller 10.

Figure 7A:
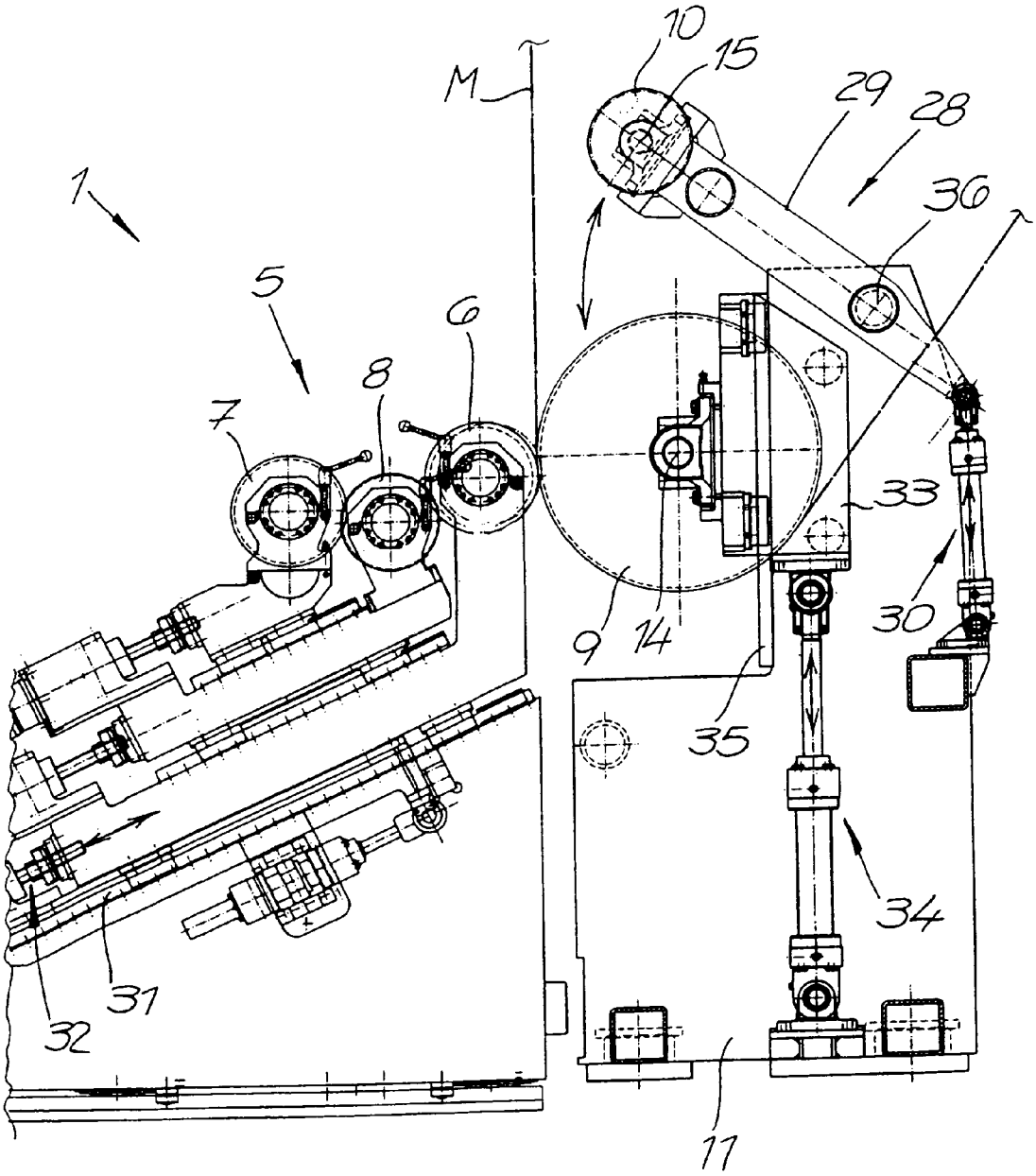
FIG. 7*a* shows a modified embodiment of a strip coating device according to the invention, in a first functional position.

In this regard, the figures show that the distance a of the surface of application roller 6 from the surface of supporting roller 9 approximately corresponds to the thickness of the strip to be coated in the first functional position, for example for coating thick strips (thickness approximately $\geqq 0.3$ mm), so that application roller 6 lies (directly) against supporting roller 9, with the interposition of strip M (cf. FIGS. 2*a*, 7*a*).

Figure 2B:
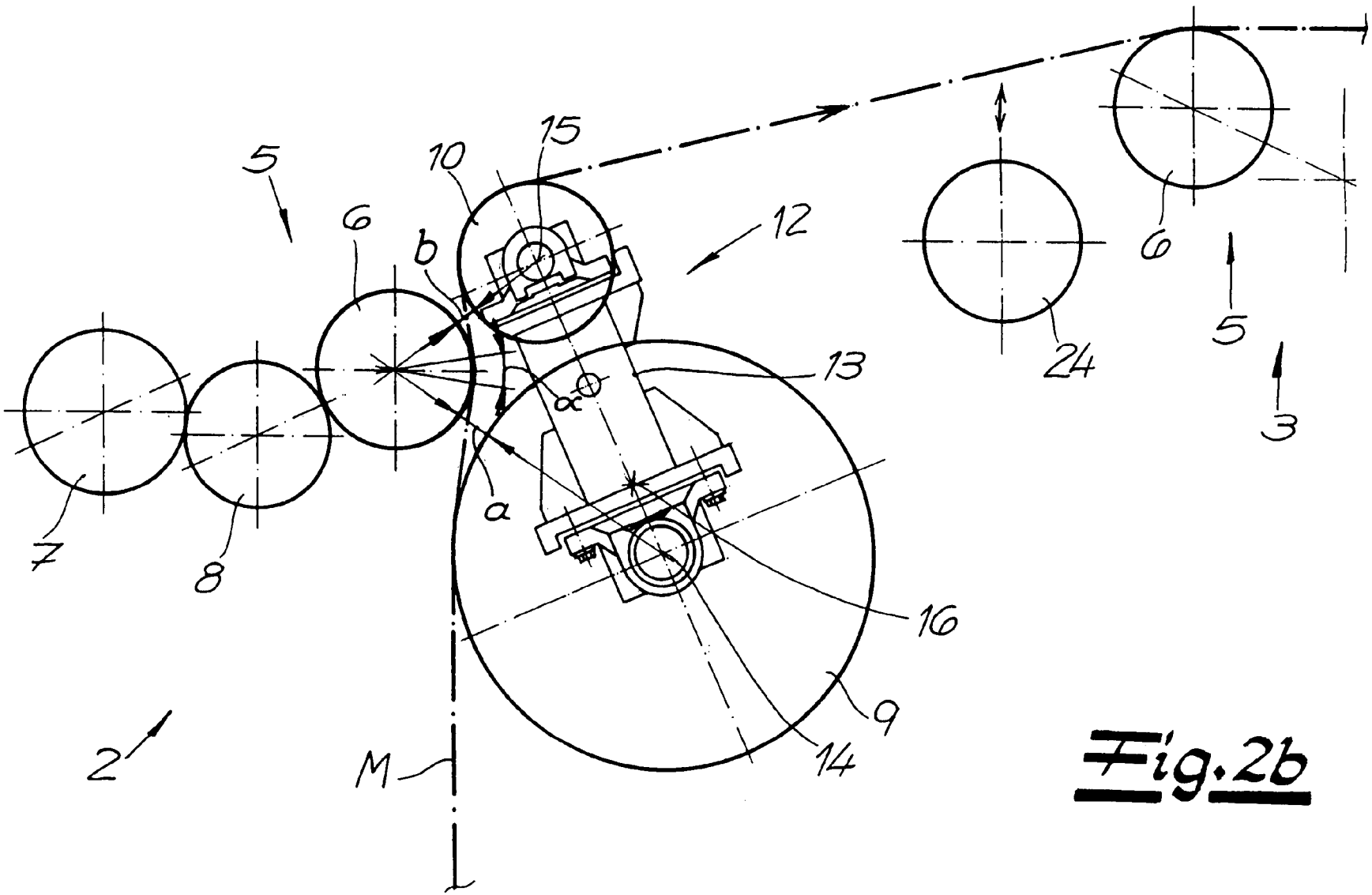
FIG. 2*b* shows the strip coating device according to FIG. 2*a* in a second functional position.
Figure 7B:
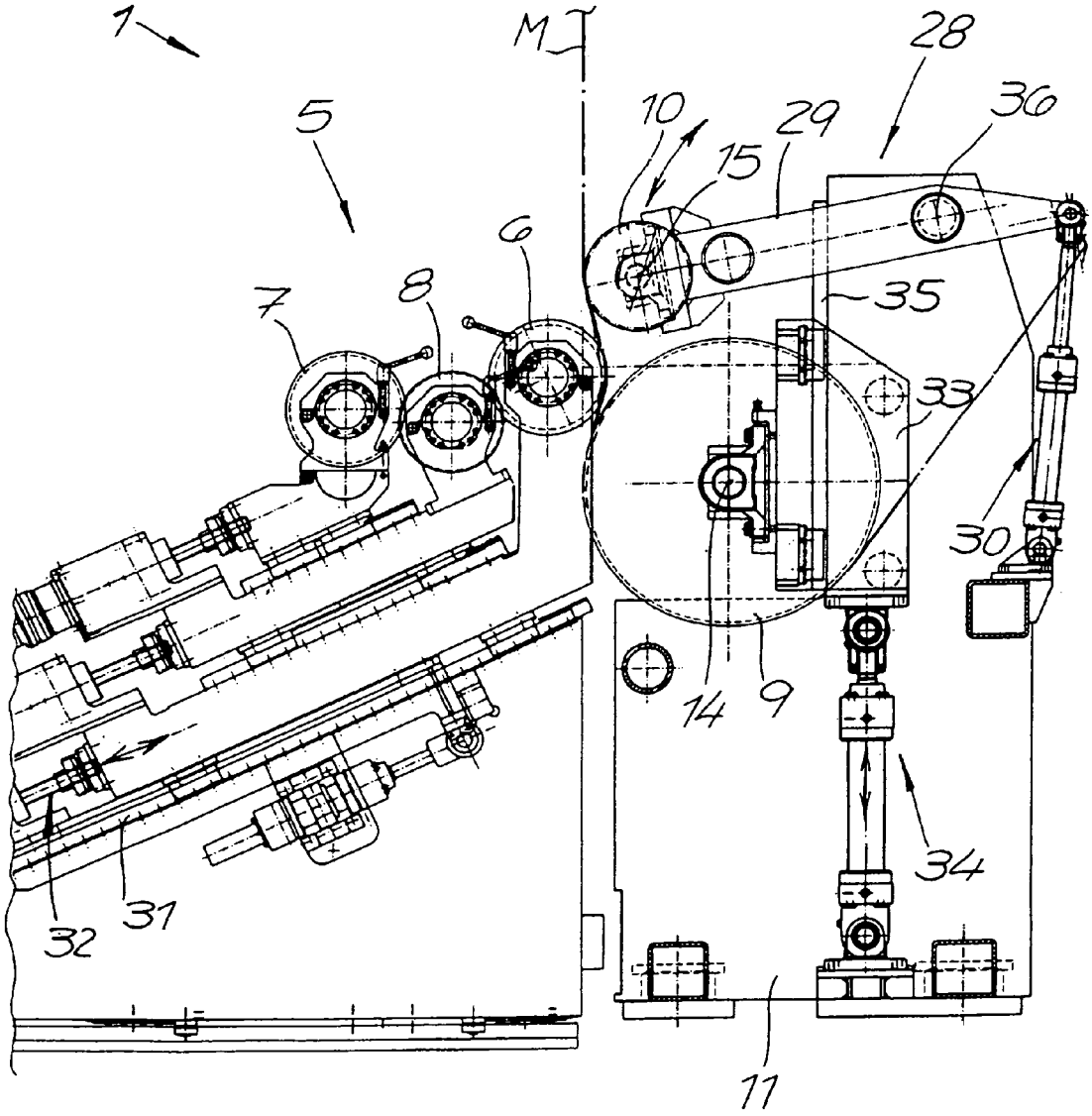
FIG. 7*b* shows the strip coating device according to FIG. 7*a* in a second functional position.

In contrast, FIGS. 2*b* and 7*b*, respectively, show that the distance a and b, respectively, of the surface of application roller 6 from the surface of supporting roller 9 and/or the surface of tensioning roller 10 is greater, by a predetermined dimension, than the thickness of strip M, in the second functional position, for example for coating thin strips (thickness approximately <0.3 mm). In this connection, it is practical if the distance a and b is selected to be greater than the strip thickness, but relatively small, in order to guarantee optimal fixation and/or guidance of the strip. In the embodiment shown, the distances a and b can be less than 10 mm, if possible less than 5 mm.

Furthermore, FIGS. 2*a* and 7*b* show that the looping angle a of strip M around application roller 6 is less than 40°, preferably less than 30°, in the second functional position. In the exemplary embodiment, angle a lies between 10° and 20°. It can be adjusted by adjusting the immersion depth of application roller 6 into the region between supporting roller 9 and tensioning roller 10.

According to the invention, supporting roller 9 and tensioning roller 10 are disposed in a common roller frame. The position of supporting roller 9 and/or tensioning roller 10 within this frame is adjustable, for a switch from one functional position into the other functional position. In this connection, the switch in functional position takes place primarily by a change in the position of the supporting roller and/or tensioning roller. Consequently, the application head merely has to be moved slightly for an adaptation to the functional position.

FIGS. 2*a* and *b* as well as 3 to 6 show an embodiment of a coating device 2 according to the invention, in which tensioning roller 10 and supporting roller 9 are each mounted in a rotary frame 12 so as to rotate. Rotary frame 12 itself is mounted in roller frame 11. Coating device 2 is consequently brought from the first functional position into the second functional position, and vice versa, by rotating rotary frame 12. Rotary frame 12 has two rotary arms 13 that connect supporting roller 9 and tensioning roller 10 with one another at their faces.

Figure 3:
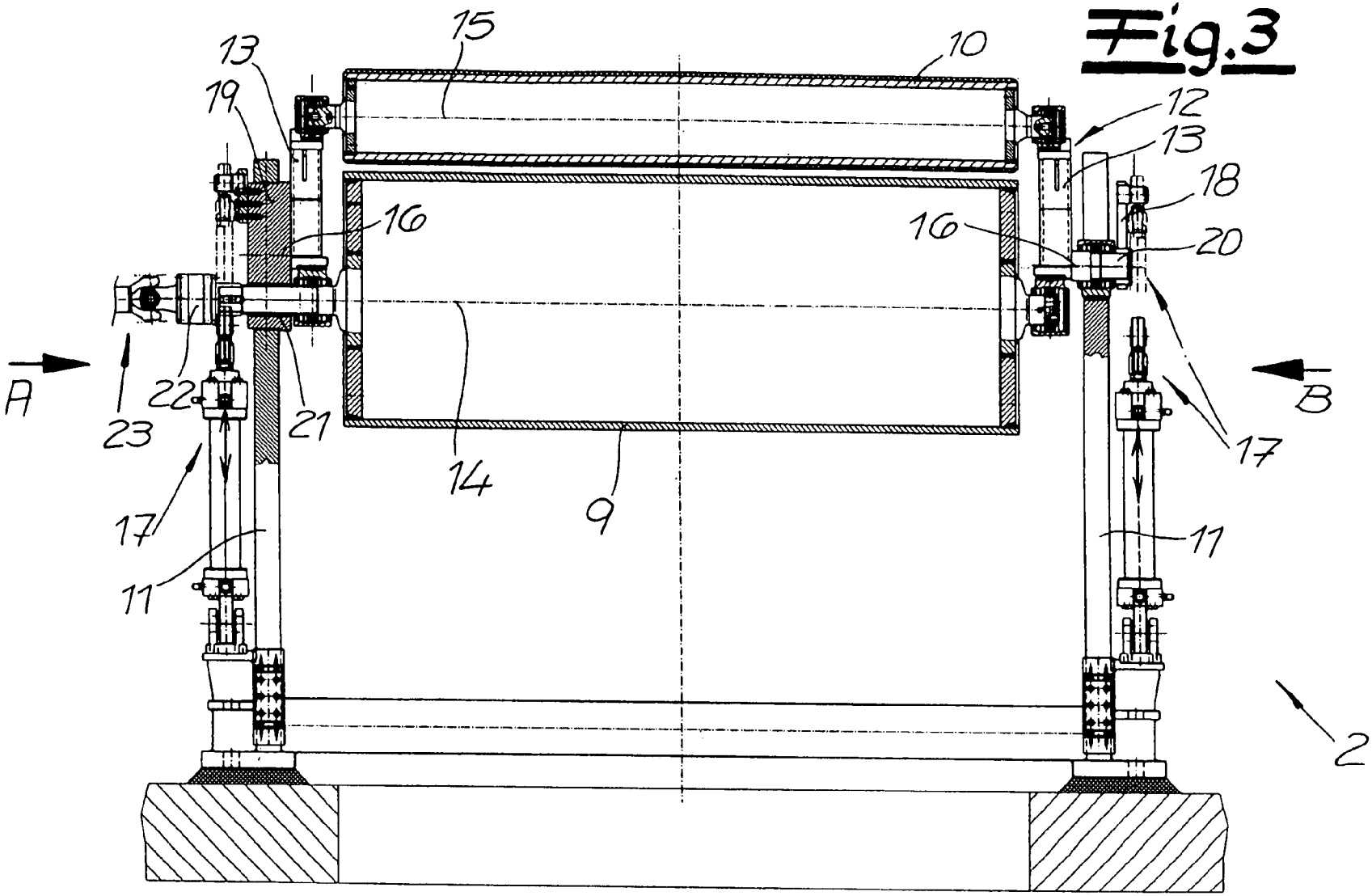
FIG. 3 shows the strip coating device according to FIG. 2*b* in a frontal view (without strip and without application head)
Figure 4:
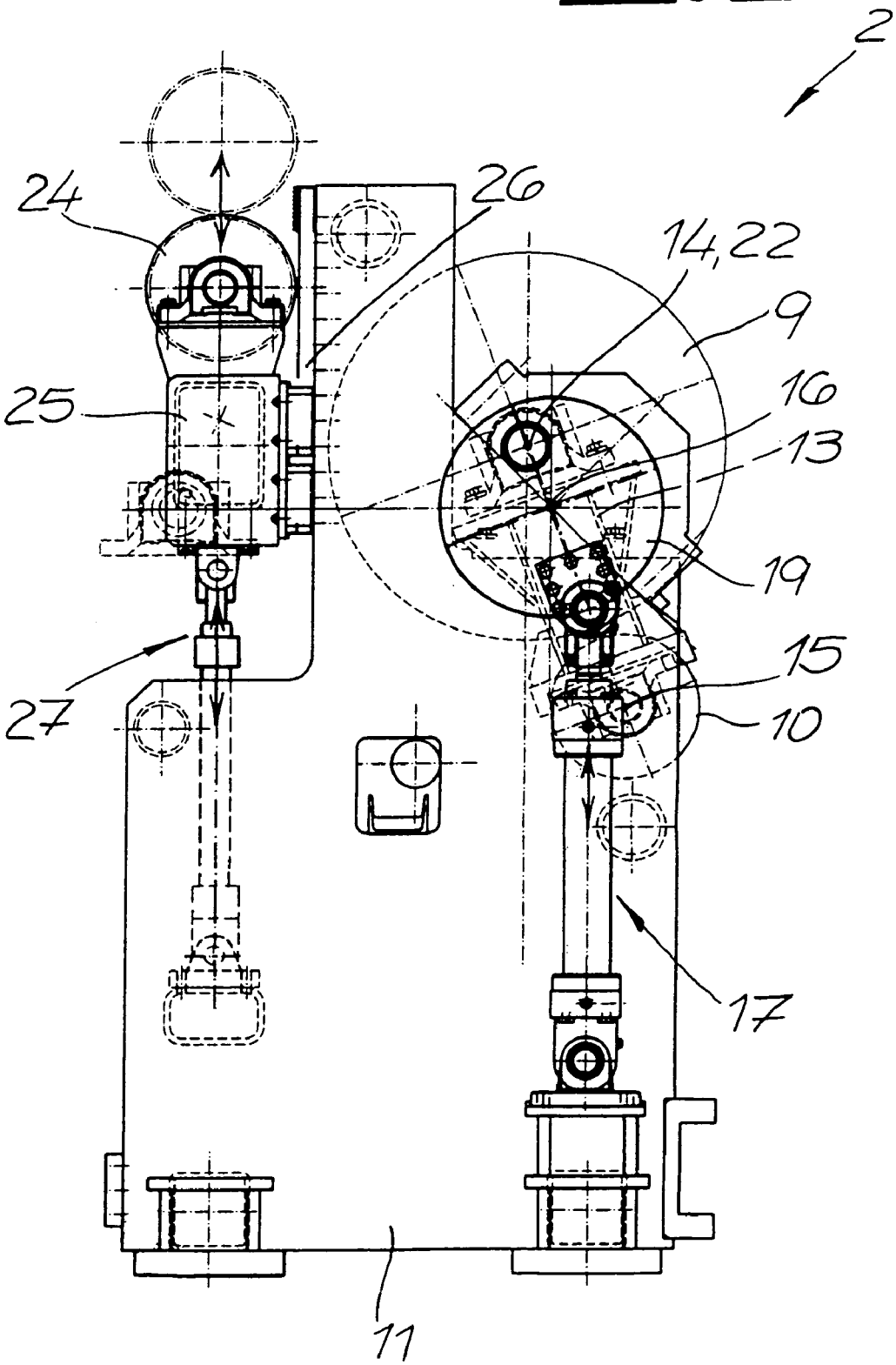
FIG. 4 shows the object according to FIG. 3 in a side view, from the direction of the arrow A, in the first functional position.
Figure 5:
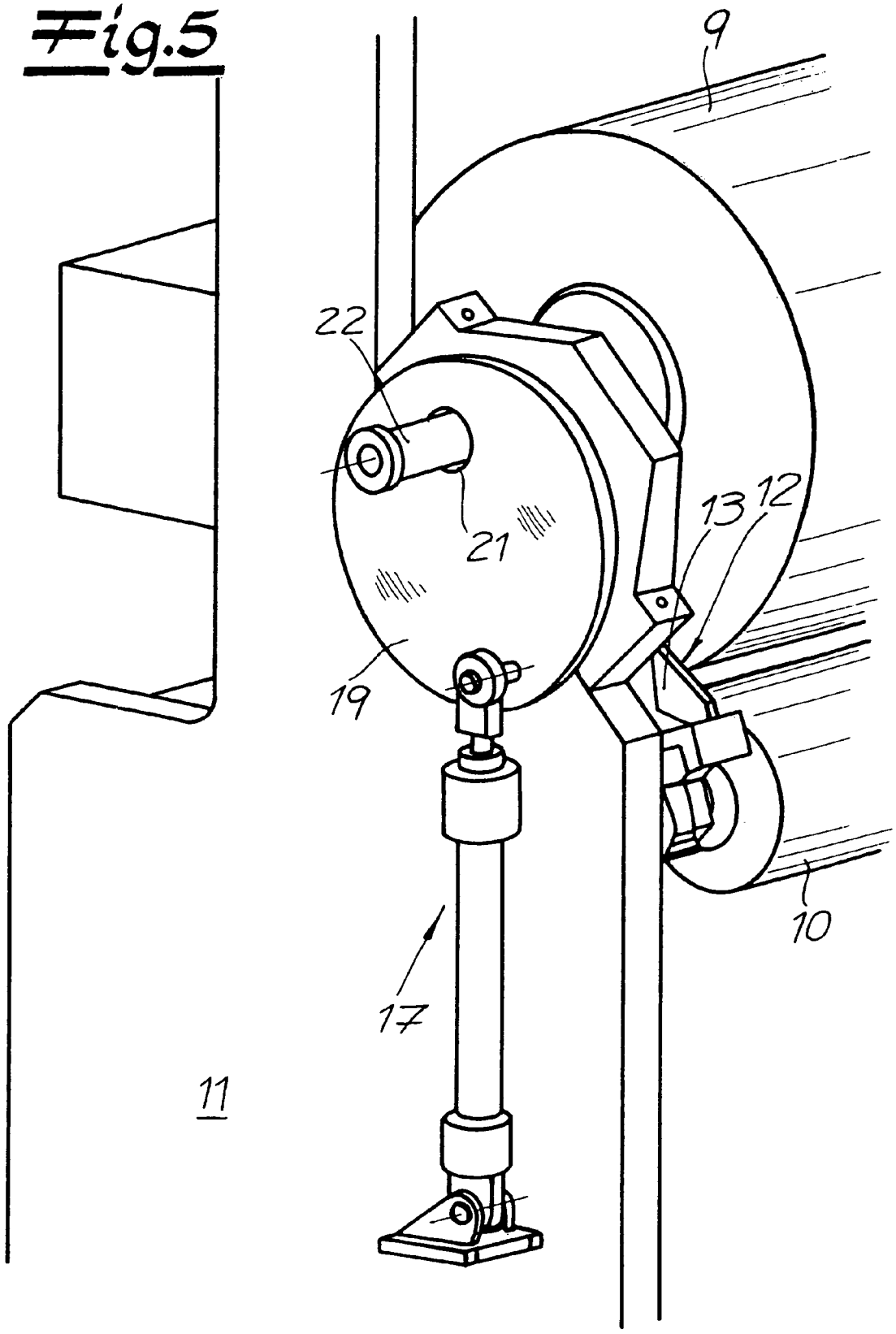
FIG. 5 shows the object according to FIG. 3 in a perspective view, from the direction of the arrow A.
Figure 6:
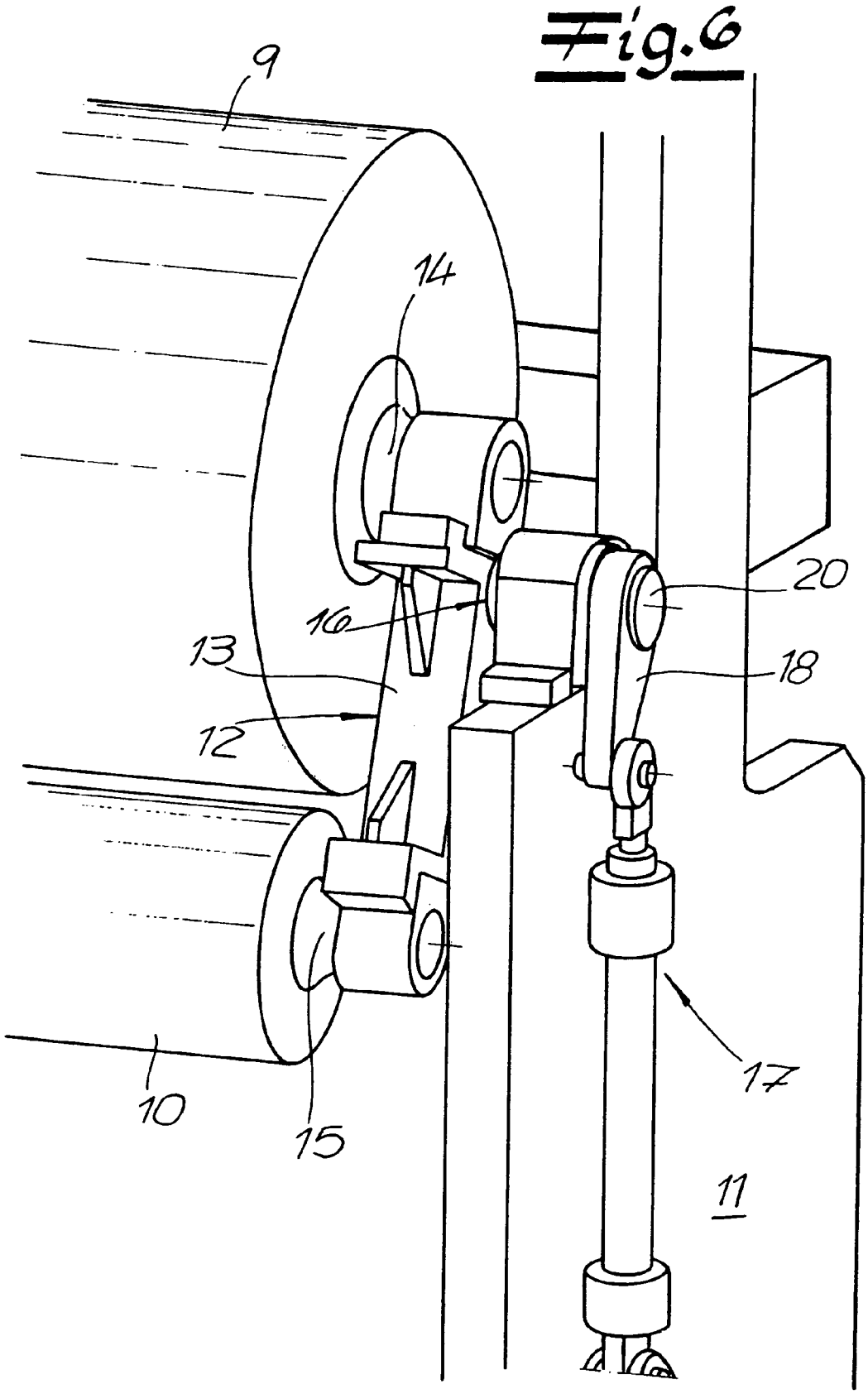
FIG. 6 shows the object according to FIG. 3 in a perspective view, from the direction of the arrow B.

FIGS. 4, 5, and 6 show coating device 2 in the first functional position according to FIG. 2*a*. Strip M itself and also application head 5 are not shown in these figures. FIG. 3 shows coating device 2 in the second functional position according to FIG. 2*b*. Here again, strip M and application head 5 are not shown.

The figures furthermore show that supporting roller 9 and tensioning roller 10 are each mounted on rotary arms 13 at their ends. The rotary frame, i.e. its rotary arms 13, can be rotated about a rotation axis 16 disposed between rotation axes 14, 15 of rollers 9, 10. A comparison of FIG. 2 to 6 makes it clear, in this regard, that during the course of rotation of rotary frame 12, both the position of supporting roller 9 and the position of tensioning roller 10 are changed, since rotation axis 16 of rotary frame 12 is disposed between tensioning roller 10 and supporting roller 9, i.e. their rotation axes 15, 14. The switch in functional position takes place by way rotary drives 17. FIG. 3 shows that a rotary drive 17 is assigned to each rotary arm 13. These rotary drives 17 are not connected directly with rotary arms 13, but instead are linear drives that are connected with rotary arms 13 by way of a suitable transfer lever 18, 19. FIG. 3 shows that the connection by way of such transfer levers 18, 19 is configured differently on the two sides of rollers 9, 10. FIG. 6 shows the right region according to FIG. 3 from the direction of the arrow B. Here, the transfer lever is configured as a crank 18, which translates the stroke of the cylinder/piston arrangement 17 into a rotational movement of connecting shaft 20, which is connected with rotary arm 13.

In contrast, FIG. 5 shows the left region of rollers 9, 10 according to FIG. 3 from the direction of arrow A. Here, cylinder/piston arrangement 17 is connected eccentrically to a turntable 19. In FIG. 5, this turntable 19 has a perforation 21 for a drive shaft 22 of supporting roller 9. A corresponding rotation drive 23 for supporting roller 9 can be flanged onto this drive shaft 22. This is indicated in FIG. 3.

Furthermore, it is indicated in FIG. 1 that coating device 2 for top coating of the strip, which was described in detail, is directly followed by a conventional coating device 3, which allows bottom coating of the strip. In this regard, this is a conventional coating device 3, in which application head 5 works against strip M from the bottom of the strip, without any supporting roller being provided. This application head 5, just like the other application heads 5, can be moved, so that it can be moved out of the strip region if no bottom coating is supposed to take place. In FIGS. 2*a* and 2*b*, application roller 6 of this supplemental application head 5 is indicated in a functional position in which supplemental bottom coating of the strip takes place. For the case that this supplemental application head 5 is not used, a supplemental ancillary roller 24 is provided, which is indicated in FIG. 2*b* and can be moved against the strip. In FIG. 4, this ancillary roller is disposed on roller frame 11 of the coating device 2 so that it can be lifted and lowered. Ancillary roller 24 is mounted on a carrier 25, so as to rotate, which carrier 25 is guided on linear guides 26 and can be moved, namely lifted and lowered, by a cylinder/piston arrangement 27 connected with the carrier.

Figure 8:
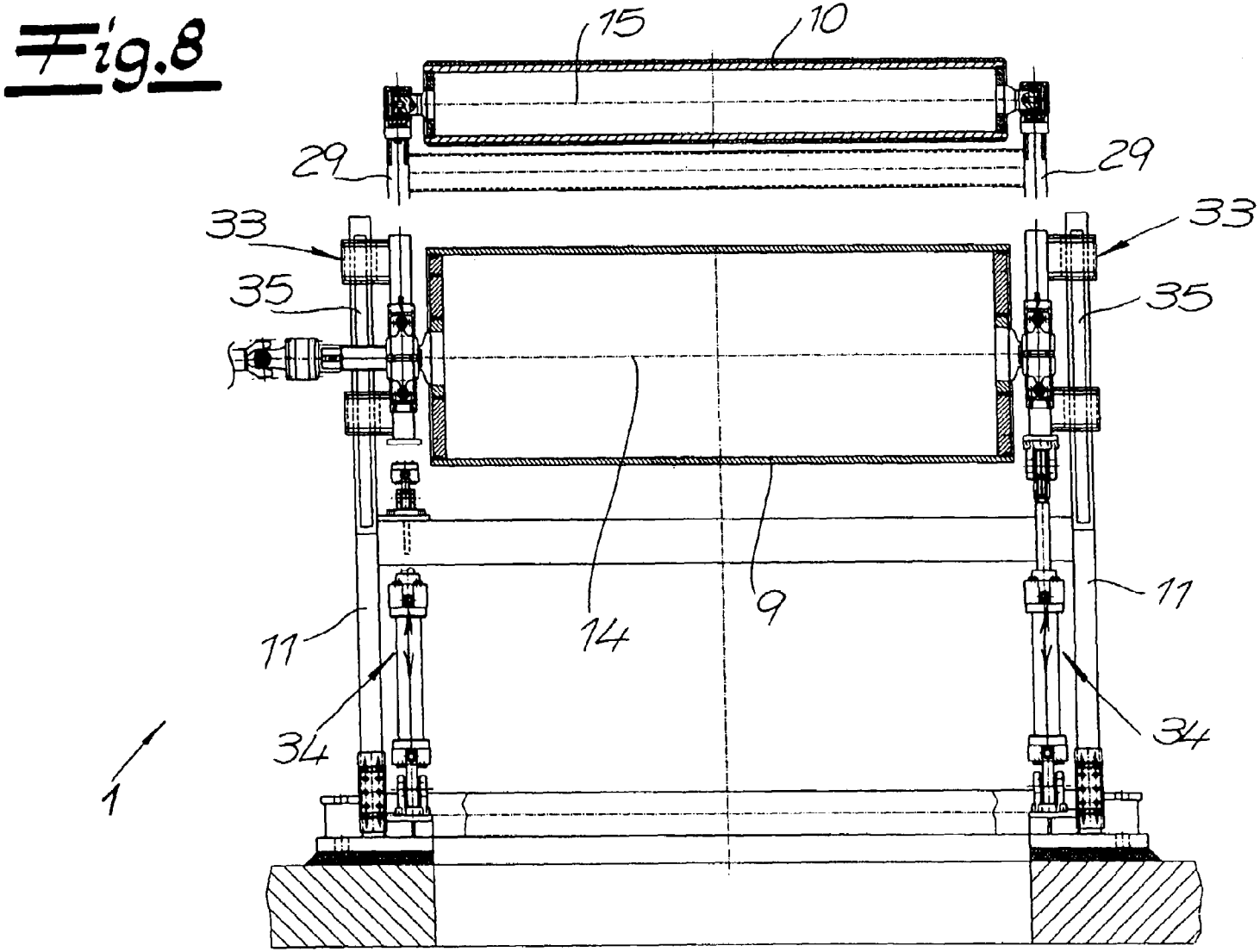
FIG. 8 shows the strip coating device according to FIG. 7*a* in a frontal view (without strip and without application head).

While FIGS. 2 and 6 show an embodiment of the invention using the example of the second coating device 2 according to FIG. 1, the first coating device 1 disposed below the former, according to FIG. 1, is a modified embodiment of the invention, in which tensioning roller 10 and supporting roller 9 are not moved jointly in a rotary frame, but rather in which tensioning roller 10 is mounted to rotate on a pivot frame 28. Tensioning roller 10 is pivoted out of the first functional position into the second functional position, relative to supporting roller 9, with this pivot frame 28. This modified embodiment is shown in detail in FIGS. 7*a*, 7*b*, and 8. FIG. 7*a* shows coating device 1 in the first functional position, in which application head 5 works directly against supporting roller 9. Tensioning roller 10 is pivoted out of the region of metal strip M, using pivot frame 28. For pivoting the pivot frame 28 about the pivot axis 36, pivot drives 30, which are configured as cylinder/piston arrangements, are connected at its pivot arms 29. These pivot drives, i.e. cylinder/piston arrangements 30, are pivotably connected with the roller frame and with the pivot lever. Tensioning roller 10 is mounted on the one side of pivot axis 36, with its end, while pivot drives 30 are connected with the other end of pivot arms 29, at their ends, so that pivot axis 36 is disposed between rotation axis 15 and tensioning roller 10 and the linkage point of pivot drives 30.

If, for example when coating thin strips, coating is to take place not against supporting roller 9, but rather against the free strip, then strip coating device 1 can be brought from the first functional position shown in FIG. 7*a* into the second functional position shown in FIG. 7*b*. For this purpose, pivot frame 28 is pivoted, using pivot drives 30, and thus tensioning roller 10 is pivoted against metal strip M. Furthermore, a comparison of FIGS. 7*a* and 7*b* shows that application head 5 was moved forward by a slight dimension, in its linear guide 31, by a drive 32, against the strip. With this, application head 5 presses against metal strip M with its application roller 6, between supporting roller 9 tensioning roller 10. Furthermore, a comparison of FIGS. 7*a* and 7*b* shows that supplementally, supporting roller 9 was lowered by a predetermined dimension, within roller frame 11. For this purpose, supporting roller 9 is mounted on a hoist frame 33, so as to rotate, which frame can be lifted and lowered in a hoist drive 34. Hoist drive 34 is also configured as a cylinder/piston arrangement. Hoist frame 33 is guided on guide rails 35 of roller frame 11, by way of linear guides.

Accordingly, while only a few embodiments of the present invention have been shown and described, it is obvious that many changes and modifications may be made thereunto without departing from the spirit and scope of the invention.

What is claimed is:

1. A strip coating device, comprising:

at least one application head for applying coating substances to a strip passing through the coating device, the application head comprising:

at least one application roller that applies the coating substance to the strip;

at least one supporting roller disposed on a side of the strip opposite the application head; and at least one tensioning roller assigned to the supporting roller, said tensioning roller being located on a side of the strip that lies opposite the application head;

wherein the application head works on the strip either in a first functional position, where the strip is supported by the supporting roller, or, in a second functional position, in a free strip region away from the supporting roller, wherein in the first functional position, the application roller is directly in a region of the supporting roller, and in the second functional position, the application roller is between the supporting roller and tensioning roller, wherein the supporting roller and the tensioning roller are mounted to rotate in a rotary frame that is rotatably mounted within a common roller frame, and wherein a position of the supporting roller or the tensioning roller within the roller frame is adjustable, for a switch between the first functional position and the second functional position.

2. A device according to claim 1, wherein a distance (a) between a surface of the application roller and a surface of the supporting roller approximately corresponds to a thickness of the strip to be coated in the first functional position, and wherein a distance between the surface of the application roller and the surface of the supporting roller or the surface of the tensioning roller is greater, by a predetermined dimension, than the thickness of the strip to be coated in the second functional position.

3. A device according to claim 2, wherein the distance between the surface of the application roller and the surface of the supporting roller and/or the surface of the tensioning roller in the second functional position is less than 20 mm.

4. A device according to claim 1, wherein a looping angle of the strip around the application roller is less than 40° in the second functional position.

5. A device according to claim 1, wherein the rotary frame has at least two rotary arms that connect the supporting roller and the tensioning roller with one another on their faces.

6. A device according to claim 5, wherein ends of the supporting roller and the tensioning roller are mounted on the rotary arms, and wherein the rotary frame can be rotated about a rotation axis disposed between the rotation axes of the rollers.

7. A device according to claim 6, wherein the rotary drives are configured as linear drives which are connected with the rotary arms directly or by way of at least one transfer lever.

8. A device according to claim 1, further comprising one or more rotary drives connected with the rotary frame.

9. A device according to claim 8, wherein the transfer lever is configured as a crank or turntable.

10. A strip coating device, comprising:

at least one application head for applying coating substances to a strip passing through the coating device, the application head comprising:

at least one application roller that applies the coating substance to the strip;

at least one supporting roller disposed on a side of the strip opposite the application head; and at least one tensioning roller assigned to the supporting roller, said tensioning roller being located on a side of the strip that lies opposite the application head;

wherein the application head works on the strip either in a first functional position, where the strip is supported by the supporting roller, or, in a second functional position, in a free strip region away from the supporting roller, wherein the supporting roller and the tensioning roller are disposed in or on a common roller frame, wherein a position of the supporting roller or the tensioning roller within the roller frame is adjustable, for a switch between the first functional position and the second functional position, wherein at least the tensioning roller is mounted to rotate on a pivot frame, and the pivot frame is mounted to pivot on the roller frame, and wherein the tensioning roller can be pivoted with the pivot frame for switching between the first functional position and the second functional position.

11. A device according to claim 10, wherein the pivot frame has at least two pivot arms, which can be pivoted with the tensioning roller to switch between the first functional position and the second functional position, and wherein the tensioning roller is mounted on these pivot arms.

12. A device according to claim 11, wherein the supporting roller is displaceable within the roller frame.

13. A device according to claim 10, further comprising one or more pivot drives connected with the pivot frame.

14. A device according to claim 13, wherein the pivot drives are configured as linear drives.

* * * * *

UNITED STATES PATENT AND TRADEMARK OFFICE

CERTIFICATE OF CORRECTION

PATENT NO. : 7,647,882 B2
APPLICATION NO. : 11/648405
DATED : January 19, 2010
INVENTOR(S) : Michelbrink et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 236 days.

Signed and Sealed this

Sixteenth Day of November, 2010

David J. Kappos

David J. Kappos
*Director of the United States Patent and Trademark Office*